United States Patent [19]

Lindblad

[11] 4,137,611

[45] Feb. 6, 1979

[54] LATCH MECHANISM FOR SAFETY BELTS

[76] Inventor: Stig M. Lindblad, 20 rue Saint-Pierre, CH-1701 Fribourg, Switzerland

[21] Appl. No.: 853,887

[22] Filed: Nov. 22, 1977

[30] Foreign Application Priority Data

Nov. 22, 1976 [SE] Sweden ..... 7613014

[51] Int. Cl.[2] ..... A44B 11/25

[52] U.S. Cl. ..... 24/230 AL

[58] Field of Search ..... 24/230 AL, 230 R, 230 A, 24/230 AK

[56] References Cited

U.S. PATENT DOCUMENTS

| | | | |
|---|---|---|---|
| 4,004,115 | 1/1977 | Esner | 24/230 A |
| 4,025,992 | 5/1977 | Lindblad | 24/230 AL |
| 4,047,267 | 9/1977 | Lindblad | 24/230 AL |

*Primary Examiner*—Kenneth J. Dorner

[57] ABSTRACT

Latch mechanism for safety belts provided with belt means and two connectable members, provided for a releasable anchoring of the belt means to a vehicle. One of said members consists of a locking member and the other member consists of a latch member. The latch member comprises at least one locking device, which is movable between a first, unlocking position releasing the locking member and a second position, locking the same. The latch member further comprises maneuvering means, provided to be actuated from the outside of the latch member for said moving of the locking device and to be caught in a position in which the locking device is retained in its first, unlocking position when the locking member is disconnected from the latch member, and a frame for the guiding of the locking device and the maneuvering device. A part is provided in the locking, second position of the locking device to force the maneuvering device to form a play between at least one first catch surface of the maneuvering device and at least one corresponding second catch surface connected to the frame and to release the same device from said force by the release of the locking member, admitting said catching of the maneuvering device by means of cooperation between said catch surfaces by eliminating said play.

4 Claims, 9 Drawing Figures

LATCH MECHANISM FOR SAFETY BELTS

The present invention relates to a latch mechanism for safety belts provided with belt means and two connectable members, provided for a releasable anchoring of the belt means to a vehicle, one of said members consisting of a locking member and the other member consisting of a latch member, comprising at least one locking device, which is moveable between a first unlocking position releasing the locking member and a second position, locking the same, maneuvering means, provided to be actuated from the outside of the latch member for said moving of the locking device and to be caught in a position in which the locking device is retained in its first unlocking position when the locking member is disconnected from the latch member, and a frame for the guiding of the locking device and the maneuvering device.

Latch mechanisms for the securing of safety belts in order to keep the wearer of the belt surrounded by at least one belt part, consist generally of two parts which are provided to be coupled together. The one part is a locking member which is provided to be locked in the other part which is a latch member. By a prior known type of latch mechanism a locking device in a latch member is provided to be in a locking position also when the locking member is freed from the latch member which means that the locking device has to be brought to an unlocking position by means of the locking member during the coupling moment. Thereby the locking member will be subjected to a force which is directed sidewards so that the locking member can be pinched in a position in which it is not totally locked. In this position the locking member can be drawn out from the latch member if the parts are loaded which means great risks for injuries to a person as the safety belt will not be reliable in a critical situation.

From the prior art it is known a latch mechanism in which the locking device is kept in an unlocked position when the locking member is removed from the latch member. In this mechanism the risk for incomplete locking is however not eliminated because a catch member in the latch member for the holding of the locking member in unactivated position in certain circumstances will not catch the locking device but leave the same free to return to its locking position when the locking member is removed from the latch member. In this position said pinching of the locking member can occur.

The object of the present invention is to obtain a latch mechanism in which the locking device in the latch member will be secured in an unlocking position when the locking member is removed from the latch member in a totally reliable way thereby eliminating every possibility of defective locking.

The object of the invention is obtained by means of a latch mechanism in which a part, forming a distance element, is provided in the locking, second position of the locking device to force the maneuvering device to form a play between at least one first catch surface of the maneuvering device and at least one corresponding second catch surface connected to the frame and to release the same device from said force by the release of the locking member, admitting said catching of the maneuvering device by means of cooperation between said catch surfaces by eliminating said play.

The present invention will in the following be described by means of an embodiment with reference to the enclosed drawings in which FIGS. 1 and 2 are longitudinal sectional views through the latch mechanism according to the invention in locking position and unlocked position respectively along the line I — I in FIG. 6 respectively along the line II — II in FIG. 5;

Figure 1:
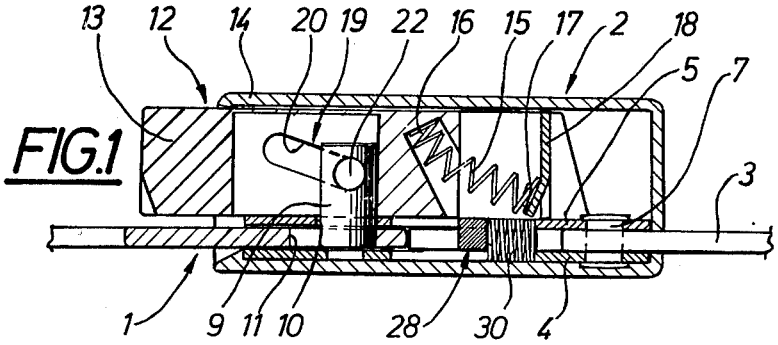

The main object of the invention is to maintain a reliable function of the latch mechanism by moderate demands according to manufacturing tolerances and dimension changes by wear in a mechanism in which the parts cooperate by eliminating of the risk that any part of the mechanism will be sticking in a non-intended position. Thereby the risk that the locking will not be complete is eliminated. This object will according to the basic idea of the invention be obtained by means of an arrangement in which a catch surface in the mechanism normally exhibits no play to a cooperating surface while a play will be present when the mechanism is subjected to an unlocking moment. Thereby a space for the parts in the unlocking movement is maintained.

According to the embodiment shown in FIGS. 1 - 7 the mechanism consists of two members which can be locked to each other, a locking member 1 and a latch member 2. The locking member 1 is e.g. attached to the belt of a safety belt while the latch member 2 by means of an anchoring part 3 is anchored to the frame of a vehicle. By loading of the latch member 2 the force will be transformed to two plates 4, 5 which are substantially parallel to each other. The first plate, the lower plate 4 is according to FIGS. 5 and 6 a part of a U-profile and includes consequently two flanges 6. The both plates 4, 5 are attached to the anchoring part 3 by means of a rivet 7 extending through the plates and the anchoring part. Between the plates is formed a chute 8 in which the locking member 1, which has the form of a tongue is insertable in order to be locked to the latch member 2. The locking is obtained by means of a locking device 9 which is movable in to and out from the chute 8 between a locking position (see FIG. 1) and an unlocking position (see FIG. 2). At least one of the plates 4, 5, in the shown embodiment the plate 5, is provided with a hole 10 (see FIG. 7) for the locking device 9 in which hole the same is movable. The locking member 1 has an opening 11 through which the locking device 9 extends in its locking position (see FIG. 1). This opening can have the same dimension as the section of the locking device e.g. circular form, but preferably the opening is slightly larger in the moving direction of the locking member than the locking device 9.

In the latch member 2 a maneuvering device 12 is provided. In the embodiment the same is intended to be maneuvered by hand by means of a key 13 obtainable from the outside and movable substantially between an outer end position (see FIGS. 1 and 3) and an inner end position (see FIGS. 2 and 4). The key 13 is guided between the one plate 5 and the inner side of a housing 14 for the latch member. The housing is not loaded by the forces transferred to the belts and can therefore be made in a material which is easy to shape as plastic while the loaded parts preferably are made of steel or metal. The key is loaded by the bias from a compression spring 15 the force of which is directed an oblique direction from the plate 5. The key 13 is consequently biased by a component force which is directed in the substantially moving direction of the key and towards the outer end position of the same and a component force which is directed out from the plate 5. The spring 15 is in order to obtain this arrangement inserted in compressed form between an oblique seat 16 in the key 13 and a second also oblique seat 17 connected to the plate 4, 5 and provided in a cross piece 18 extending between the flanges 6.

In the maneuvering device 12 is also included a link member 19 provided to transform the movement of the key 13 between the end positions of the same to the locking device 9 in order to move the same between its locking and unlocking positions. The link 19 is formed of guides 20 in the key 13 and guides 21 in the flanges 6 maneuvering transversely to the moving direction of the key. There is a guided pin 22 maneuvering through a bore in the locking device 9 and through the guides 20 as well as the guides 21. The guide pin 22 is consequently movable in the guides 21 to and fro the chute 8 when the key 13 is moved between its end positions in order to move the locking device 9 between its locking and unlocking positions.

According to the invention the maneuvering device 12 is adapted to be caught in its inner end position and is for this purpose provided with two catch portions 23 (see FIG. 7) arranged to cooperate with portions 24 on the plate 5. The catch portions 23 include sliding notches 25 arranged to cooperate with guide portions 26 maneuvering between a rest surface 27 and the catch portion 24 on the plate 5.

Figure 2:
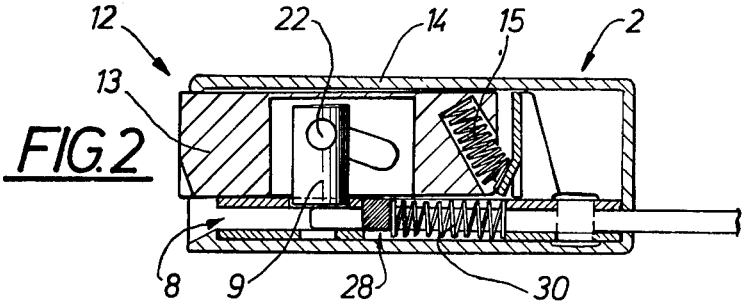
Figure 3:
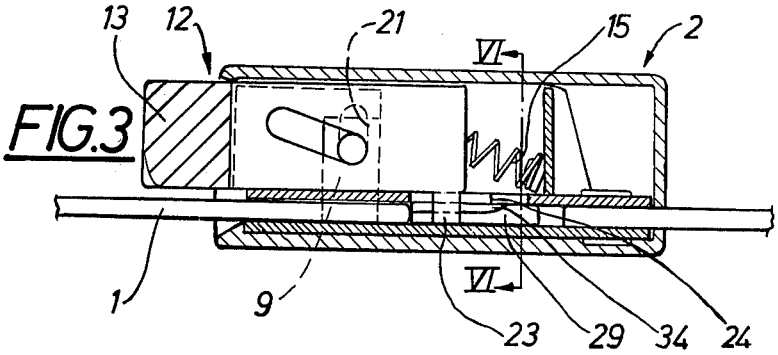
FIGS. 3 and 4 are longitudinal sectional views of the mechanism in locking respectively unlocked position along the line III — III in FIG. 6 respectively the line IV — IV in FIG. 5.
Figure 4:
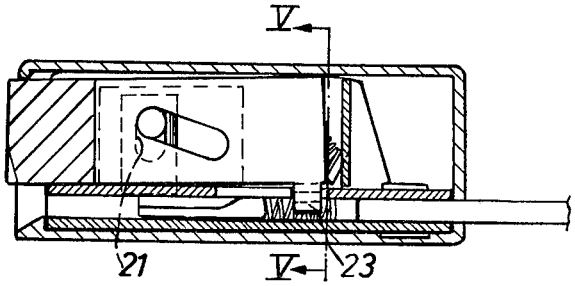

In the latch member 2 there is a rejector member 29 and a rejector compression spring 30 biasing the rejector member 29 which is movable between an inner position (see FIGS. 1 and 3) and an outer position (see FIGS. 2 and 4). The rejector member is guided in its movement by means of a slide portion 4 movable in a guide portion 31 in the plate 5. The rejector member 29 is in a known way arranged to reject the locking member 1, for example a tongue, when the locking device 9 is moved to its unlocking position by means of the key 13. This function is combined with said catching of the maneuvering device 12 according to the invention. For this purpose the rejector member 29 is provided with guides 32 extending at both sides of the member and provided to cooperate with slide notches 33 in the catch portion 23. The guides 32 are edged at the end directed towards the catch portion 24 on the plate 5. The edge portions have the reference number 34 and they have the function as distance elements according to FIG. 3 filling a play in the front of the catch portion 24 on the plate 5, a main function of the mechanism according to the invention.

Figure 5:
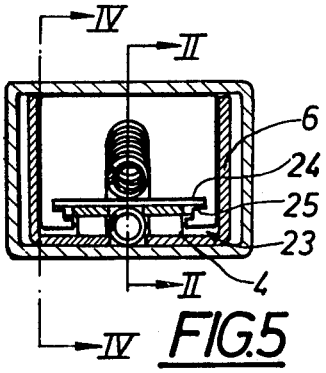
FIGS. 5 and 6 are transversal sectional views of the mechanism along the line V — V in FIG. 4 respectively the line VI — VI in FIG. 3.
Figure 6:
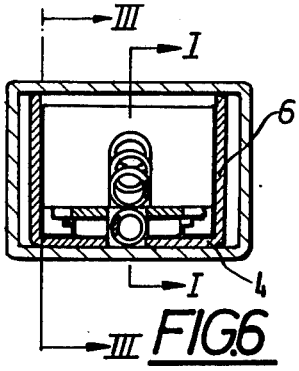
Figure 7:
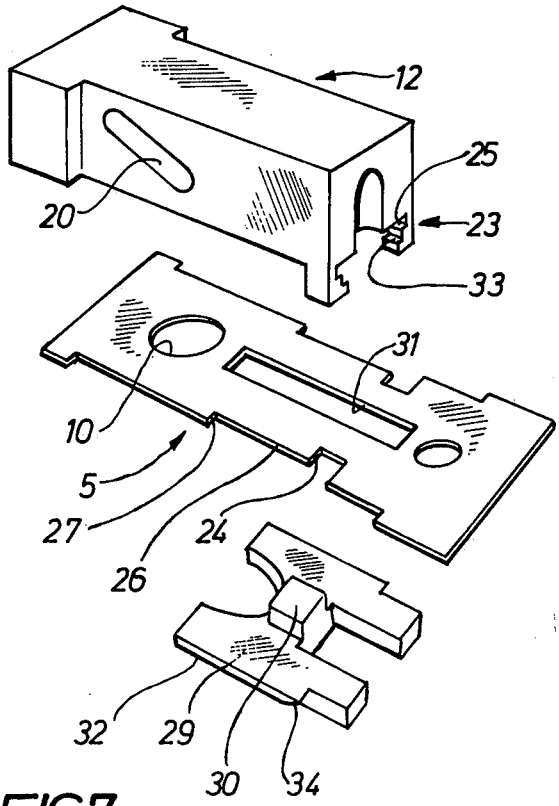
FIG. 7 is an exploded view showing some substantial parts of the mechanism according to the invention.

When the locking member is not coupled to the latch member 2 the latter is in the position shown in FIGS. 2, 4 and 5 with the maneuvering device 12 in its inner position and the locking device 9 in its unlocked position and the rejector member 29 in its outer position. In this position the maneuvering device 12 is caught by means of the forcing of the same under the bias of the spring 15 in the direction from the plate 5 and against the inner side of the housing 14. The key 13 is thereby at least with its inner end lifted from the plate 5 so that the slide notch 25 is lifted above the guide portion 26 to a position in which the catch portions 23 rest with a surface against resting surfaces of the catch portion 24 (see FIG. 5) and maneuvering device 12 is caught in its inner position. In this position there is no cooperation between the rejector member 29 and the catch portions 23.

When the locking member 1 has to be locked in the latch member 2 the same is inserted in the chute 8 thereby pushing the rejector member 29 in the direction against the inner end position of the latter by compression of the spring 30. When the rejector organ 29 with its edge portions 34 on the guides 32 reaches the edge of the catch portion 24 on the plate 5 and at the same moment also the catch portion 23 on the key 13 the edge portions 34 will work as wedges and make it possible to insert the guides 32 in the slide notches 33 of the catch portion and press the latter and also the key 13 in the direction towards the plate 5. The rest surfaces of the catch portion 23 will be moved away from the resting surfaces of the catch portion 24 as is evident from FIG. 5. Thereby the maneuvering device 12 will be free to be biased by means of the compression spring 15 to its outer end position as is shown in FIGS. 1 and 3 resulting in that the locking device 9 will be moved to its locking position in the chute 8 and in engagement with edge portions of the hole 11 in the locking member 1. The moving of the device 9 is obtained by means of the oblique guide 20 in the maneuvering device 12 which in cooperation with the guides 21 in the flanges 6 move the guide pin 22 in the direction towards the plate 5. The dimension and the positions of the parts are very important and are provided to prevent the mechanism from freeing the maneuvering device 12 before the locking member 1 is in the position in which the hole 11 is in the front of the locking device 9 and eliminating the risk that the locking member 1 will be pinched in the chute 8 in a not fully locked position.

In the locked position of the mechanism the edge portions 34 of the guides 32 on the rejector member 29 as is evident from FIG. 3 will be in a position in which they are occupying a play in the front of the resting surfaces of the catching portion 24.

When the locking member has to be released from the latch member 8 the key 13 and thereby the maneuvering device 12 is pushed inwards thereby moving with its slide notches 33 running along the guides of the rejector device 29 until they meet the edge portions 34. Simultaneously as the locking organ 9 is moved to its unlocking position by means of the maneuvering device 12 and consequently releases the locking member 1 the rejector member 9 rejects the locking member by moving to its outer position and the edge portions 34 will be removed from their position in the play in the front of the rest surfaces of the catch portion 24 allowing the maneuvering device 12 to be lifted under the bias from the spring 15. This lifting movement results in that the catch portion 23 occupies a position with its slide notches 25 above the cooperating guide 26 and with a rest surface in the front of the rest surface of the catch portion 24 of the plate 5, which occurs before the rest surfaces are in contact with each other. As the movement of the rejector member 29 to its outer position (FIG. 2) and the rejection of the locking member 1 and the catching of the maneuvering device 12 occurs simultaneously by means of the rest surfaces of the portions 23 and 24 the risk that the parts will stick in an undetermined position is eliminated as the catch movement is not possible before the rejection of the locking member 1.

Figure 8:
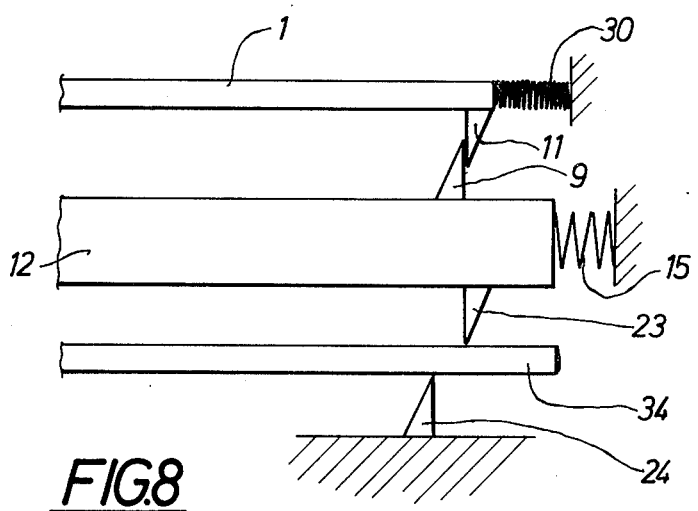
FIGS. 8 and 9 show the basic principle of the invention in a schematic way.
Figure 9:
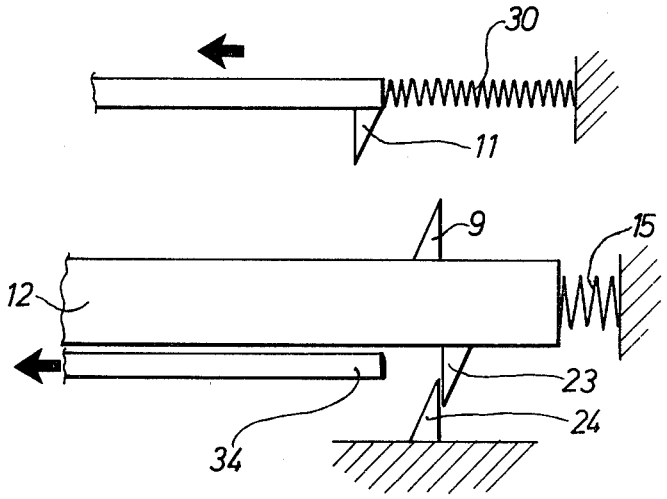

In the following the basic principle of the invention will be described in a schematical way with reference to FIGS. 8 and 9 in which the reference numbers relate to elements with the same function as parts with the corresponding numbers in the description of the embodiment. According to the invention a portion 34 occupying said play is removed when the locking member 1 is unlocked and rejected but not before. In the position shown in FIG. 8 the catch portions 23 of the maneuvering device 12 are obstructed by means of the part 34 to be caught and will not stay in this inner position as long as the locking member 1 is locked by means of the locking device 9. In FIG. 9 the position in which the locking member 1 is unlocked is shown. In this position the part 34 is removed out of the way for the movement of the catch portions 23. In this position the catch portions 23 are free to be moved to the position in which they are resting against the corresponding resting surfaces and the mechanism is in the catching position. The mechanism is provided to remove the parts 34 when the catch portions 23 are at a distance from the corresponding rest surfaces of the portions 24.

The invention is not limited to the embodiment described but can be varied within the scope of the following claims. For example it is not necessary that the part occupying the play according to the invention is included in the rejector member but can be a separate element. It is not necessary that the maneuvering device 12 move to and fro the plate 5 but the mechanism can be arranged for the movement sidewards of the maneuvering device on the plate 5. It is further possible to arrange the connection between the maneuvering device and the locking device in other ways than by means of the arrangement shown and described. It is e.g. possible to make the locking device spring loaded for the movement towards one of the end positions. The locking device can also be duplicated in order to make the mechanism resistant to higher loads. The mechanism is very advantageous if an electric contact device is desired e.g. for alarm purposes.

I claim:

1. Latch mechanism for the connection of two parts of a safety belt means and including a locking member attached to one part and a latch member attached to the other part of said means, said latch member comprising a frame having a channel in which the locking member is insertable to connect the two members, locking means movable in the frame between a releasing position out of the channel and a locking position located in the channel and cooperating with rest surfaces of the locking member when the locking means is inserted in the channel and locking the same, maneuvering means movable in the frame between a first and a second position and biased to move towards the second position, said maneuvering means being in driving connection with the locking means for actuating the same to be in its releasing position when the maneuvering means is in its first position and to be in the locking position when the maneuvering means is in its second position, a rejector element movable between an outer position in which it is biased to reject the locking member out of the channel when the same is released by the locking means and an inner position to which the rejector element is forced by the locking member when it is in its inserted position in the channel, and a catching mechanism arranged to be in an actuating position holding the maneuvering means in its first position when the rejector element is in its outer position or adjacent to its outer position and to free the maneuvering means to move to its second position when the rejector element is in or is adjacent to its inner position, said catching mechanism comprising at least one element connected to the frame and provided with a first rest surface and at least one element connected to the maneuvering means and provided with a second rest surface which is provided to be positioned behind the first rest surface when the catching mechanism is in its actuating position, whereby the rest surfaces are positioned so that the second rest surface is at a small distance behind the first rest surface when the maneuvering means is in its innermost position, the catching mechanism further comprising means connected to the rejector element and provided to obstruct the elements provided with the rest surfaces to be in front of each other when the rejector element is in its inner position and to free the elements to move in front of each other when the rejector element is in its outer position or adjacent to its outer position.

2. Latch mechanism according to claim 1 in which the means obstructing the first and second surfaces to be in front of each other is an elongated portion on the rejector element arranged to be inserted between the elements provided with the first and the second rest surfaces and forcing the elements to be out of line with each other when the rejector element is in its inner position, said elongated portion being provided with a terminating edge which is positioned to be at a distance from the first rest surface when the rejector element is in its outer position so that the elements provided with said surfaces are free to be biased in front of each other.

3. Latch mechanism according to claim 2 in which the maneuvering means comprises an element which is movable in the frame between its first and second positions and provided with at least one portion forming said element with the second rest surface, said portion being movable in a direction crosswise to the direction of the movement of the element between the first and the second positions, the frame being provided with at least one portion forming a guiding surface terminating with an edge forming the first rest surface, the portion of the maneuvering means being arranged to slide on said guiding surface by the movement of the element between its first and second positions and to move in the crosswise direction when the portion provided with the second surface reaches the edge of the guiding portion and when the rejector element is in its outer position or adjacent to its outer position, so that said portion of the maneuvering means is free to move in said crosswise direction.

4. Latch mechanism according to claim 3 in which the terminating edge of the elongated portion of the rejector element is wedge-like and provided to be inserted between the elements with the rest surfaces when the rejector element is moved to its inner position.

* * * * *